US005890752A

United States Patent [19]

Lin

[11] Patent Number: 5,890,752

[45] Date of Patent: Apr. 6, 1999

[54] PUSH-TYPE LOCK FOR FIRE-BLOCKING DOORS

[76] Inventor: Chin-Tien Lin, No.2, Lane 112, Hsu-Yuen Rd., Hsin-Chuang, Taipei Hsien, Taiwan

[21] Appl. No.: 759,144

[22] Filed: Dec. 2, 1996

[51] Int. Cl.[6] ..... E05B 65/10

[52] U.S. Cl. ..... 292/92; 292/DIG. 65

[58] Field of Search ..... 292/92, 169.13–169.18, 292/DIG. 65; 70/92, DIG. 10; 169/42, 26, 19, 37

[56] References Cited

U.S. PATENT DOCUMENTS

| | | | |
|---|---|---|---|
| 3,392,787 | 7/1968 | Weise | 169/42 |
| 3,567,942 | 3/1971 | Bach | 292/327 |
| 3,638,733 | 2/1972 | De Rouville | 169/42 |
| 3,705,739 | 12/1972 | Adler | 292/92 |
| 4,003,593 | 1/1977 | Wilzig | 292/92 |
| 4,577,544 | 3/1986 | Lee | 169/42 |
| 4,709,950 | 12/1987 | Zortman | 70/92 |
| 5,121,950 | 6/1992 | Davidian | 292/92 |
| 5,219,385 | 6/1993 | Yeh | 292/92 |

*Primary Examiner*—Steven Meyers
*Assistant Examiner*—Gary Estremsky
*Attorney, Agent, or Firm*—Barnes & Thornburg

[57] ABSTRACT

A push-type lock for fire-blocking door which includes a base body, a frame mounted on the base body, a latching member pivotally mounted on the frame, an actuating piece mounted also on the frame, and a safety release unit penetratingly secured for the frame. The safety release unit includes a rod member, an inner end and an outer end formed on both ends of the rod member respectively, a spiral spring coupled axially to the rod member and positioned between the inner end and an inner surface of the frame, and a hot-melt member sleeving the rod member between the outer end and an outer surface of the frame and subject to being melted away when heated. As a consequence of the hot-melt member being melted away, the rod member will be moved to the inside of the frame due to the compressed spiral spring, thus allowing the rod member to be moved to a position blocking up the way the latching member can be withdrawn to the inside of the frame. In this case, the latching member is prevented from being withdrawn to the inside of the frame, thus securely latching the door when a fire breaks out.

13 Claims, 6 Drawing Sheets

PUSH-TYPE LOCK FOR FIRE-BLOCKING DOORS

BACKGROUND OF THE INVENTION

1. Field of the Invention

This invention relates to door locks, and more particularly, to a push-type lock for fire-blocking doors that are used in the event of a fire to prevent the fire from spreading to the emergency staircase.

2. Description of Related Art

A prior art push-type lock for fire-blocking doors is shown in FIGS. 1 and 2. This push-type lock is composed of a casing 10', a frame 11', a mount 20', a push plate 30', an actuating piece 15', and a pivotal latching member 16'. The pivotal latching member 16' has a rear end formed with a protruding piece 19' having a tip abutting on the free end 151' of the actuating piece 15'. A movable arm 24' and a stop pin 17' are coupled to the underneath of the actuating piece 15'. The free end of the stop pin 17' can be propelled by a spring 18' into a slot 161' formed on the back of the pivotal latching member 16' and in which case the pivotal latching member 16' is stopped by the stop pin 17 and thus cannot be withdrawn to the inside of the casing 10'. When a person wants to open a door installed with the push-type lock, he/she can press the push plate 30' by hand. This causes the actuating piece 15' to be pivoted in a direction as indicated by the arrow in FIG. 2, thereby impelling the movable arm 24' and the stop pin 17', and thereby withdrawing the free end of the stop pin 17' away from the slot 161' on the back of the pivotal latching member 16'. As a result of this, the free end 151' of the actuating piece 15' is impelled upwards, thereby urging against the protruding piece 19' of the pivotal latching member 16' and causing the same to pivot in the clockwise direction (with reference to the side view of FIG. 2). This action causes the pivotal latching member 16' to withdraw from the outside of the casing 10' to the inside thereof, thus allowing the door currently being latched by the pivotal latching member 16' to be unlatched. In normal condition, the door is latched by the push-type lock. However, it is a drawback of this prior art push-type lock that when a fire breaks out, the constituent parts of the push-type lock could be deformed due to the heat from the fire. For instances, the stop pin 17' could be heated to bend and thus has its free end withdraw from the slot 161', or the actuating piece 15' could be deformed that causes the free end 151' thereof to be disengaged from the pivotal latching member 16'. All of these could cause the pivotal latching member 16' to be unable to latch the door securely, or result in the withdrawal of the pivotal latching member 16' to the inside of the casing 10'. The door thus could be pushed open by the explosive, heated air from the fire, thus adversely causing the fire to spread to the next, room.

There exists, therefore, a need for an improved push-type lock for fire-blocking doors that will not be deformed due to heat and notwithstanding latch the door securely when a fire breaks out.

SUMMARY OF THE INVENTION

It is therefore a primary objective of the present invention to provide a push-type lock for fire-blocking doors which will not have its latching member disengaged from the latching position due to heat from a fire.

It is another objective of the present invention to provide a push-type lock for fire-blocking doors whose constituent parts will not be subjected to deformation due to heat from a fire.

It is still another objective of the present invention to provide a push-type lock for fire-blocking doors which will have its latching member fixedly secured in the latching position when the ambient temperature rises to a preset limit so as to allow the door to be securely latched during a fire.

In accordance with the foregoing and other objectives of the present invention, a new and improved push-type lock for fire-blocking doors is provided. The push-type lock includes a base body, a frame which is substantially U-shaped in cross section and mounted on the base body, a latching member pivotally mounted on the frame, an actuating piece mounted also on the frame, and a safety release unit penetrating secured to one side of the frame so as to be supported thereon.

The base body includes a plate member and a deformation preventing sidewall integrally formed on one side of the plate member adjacent to the latching member. Further, a driving unit including a pivoting body having a keyhole therethrough and a driving bar pivotally connected to one end of said pivoting body is mounted on the base body, in which the driving bar is composed of a base portion and an upward extended portion integrally connected to the free end of the base portion.

The frame includes a pair of parallel, upright arranged bearing plates and a covering piece which connects the top of each of the bearing plates. On the bearing plates, a pair of first pivotal holes are provided on the front side for supporting a first shaft, and a pair of second pivotal holes are provided on the rear side for supporting a second shaft. The first shaft is axially coupled with a number of components including a safety latching member, a first spiral spring, a first deformation preventing piece and a second deformation preventing piece used to guard the latching member therebetween, and a second spiral spring. A stop bolt is provided on one side surface of the safety latching member. The first spiral spring has one elongated end elastically urging against the bottom of the covering piece and the other elongated end elastically urging against the stop bolt. This allows the safety latching member to be positioned on the outside of the frame when subjected to no external force. As to the latching member, it includes a latch body, an actuating portion integrally formed on the top side of the latch body, and a stop portion integrally formed on the bottom side of the latch body. The second spiral spring has one elongated end urging against the bottom of the covering piece, and the other elongated end urging against said latch body of the latching member, thereby allowing the latching member to be propelled to the outside of the frame when the latching member is subjected to no external force, and allowing the stop portion of the latching member to abut on the deformation preventing sidewall of the base body.

The actuating piece is pivotally coupled to the second shaft and includes a driving portion and a passive portion extended oppositely from either sides of the second shaft. The passive portion is further formed with an urging piece extending downwards from a free end thereof, a fork-like driving piece extending downwards from the bottom near the second shaft, and a tongue-like piece, which is spaced from the urging piece, extending from the free end thereof. The passive portion of the actuating piece is extended to the underneath of the actuating portion of the latching member. When the driving portion of the actuating piece is pressed down, the passive portion will be pivoted to turn about the second shaft, thereby urging upwards against the actuating portion. As a result of this, the latching member is pivoted to turn in another direction about the first shaft, thereby causing the latch body of the latching member to be withdrawn to the inside of the frame.

The safety release unit is penetratingly secured to one of the bearing plates of the frame and includes a rod member, an inner end formed on one end of the rod member, an outer end formed on the other end of the rod member, an elastic member coupled axially to the rod member and positioned in compressed condition between the inner end and the inner surface of the bearing plate of the frame, and a hot-melt member sleeving the rod member between the outer end and the outer surface of the bearing plate of the frame. The hot-melt member is made of a hot-melt plastic material, allowing the hot-melt member to be melted away when a fire breaks out. As a consequence of the hot-melt member being melted away, the rod member will be moved to the inside of the frame due to the elasticity of the compressed elastic member, thus allowing the stop pin to be moved to a Position blocking up the way the latching member can be withdrawn to the inside of the frame. In this case, the latching member is prevented from being withdrawn to the inside of the frame, thus securely latching the door when a fire breaks out.

BRIEF DESCRIPTION OF DRAWINGS

The invention can be more fully understood from the following detailed description of the preferred embodiments, with reference made to the accompanying drawings, wherein.

DETAILED DESCRIPTION OF PREFERRED EMBODIMENT

Figure 1:
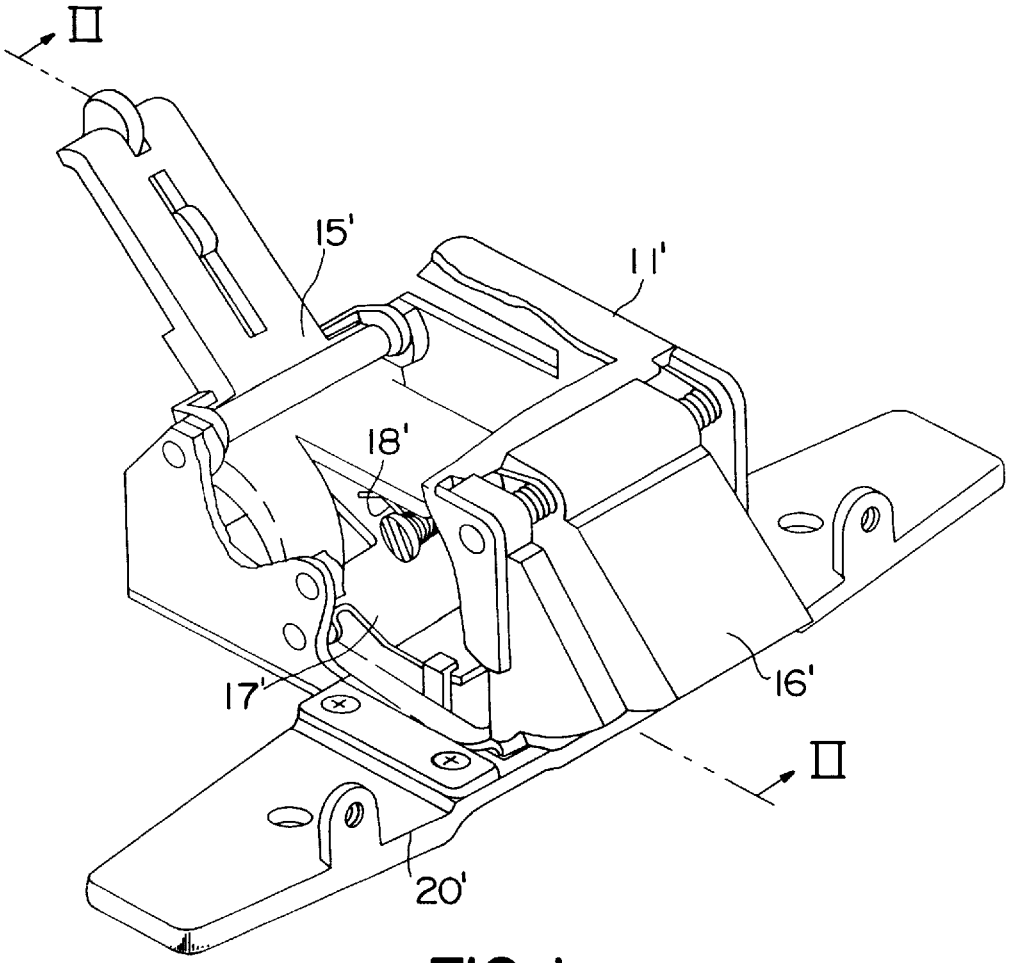
FIG. 1 PRIOR ART
FIG. 1 is a perspective view of a prior art push-type lock for fire-blocking doors, with part cut away to show the inside structure.
Figure 2:
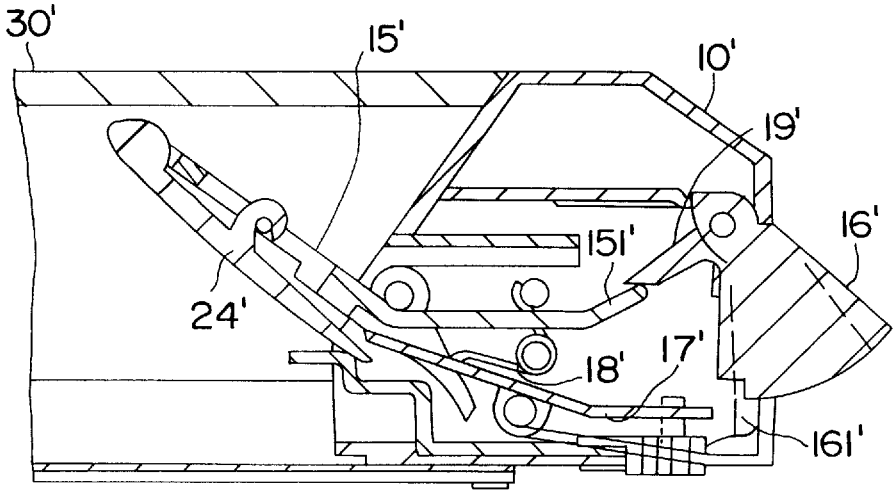
FIG. 2 PRIOR ART
FIG. 2 is a sectional view of the prior art push-type lock of FIG. 1 cutting through the line A—A.

Referring to FIGS. 3 through 9, the push-type lock for fire-blocking doors according to the present invention is composed of a base body 1, a frame 2 which is U-shaped in cross section and mounted on the base body 1, a latching member 3 pivotally mounted on the frame 2, an actuating piece 4 mounted also on the frame 2, and a safety release unit 5 penetratingly secured to the frame 2. The base body 1 includes a plate member 10 and a deformation preventing sidewall 11 integrally formed on one side of the plate member 10 adjacent to the latching member 3. Further, a driving unit 12 including a pivoting body 120 having a keyhole 121 formed therethrough, and a driving bar 122 pivotally connected to the pivoting body 120 and having a base portion 123 and an upward extended portion 124 integrally coupled to a free end of the base portion 123.

The frame 2 includes a pair of parallel, upright arranged bearing plates 202, 204 and a covering piece 21 which connects the top of each of the bearing plates 202, 204. On the bearing plates 202, 204, a pair of first pivotal holes 222 (not shown), 224 are provided on the front side for supporting a first shaft 22, and a pair of second pivotal holes 232, 234 are provided on the rear side for supporting a second shaft 23.

Figure 3:
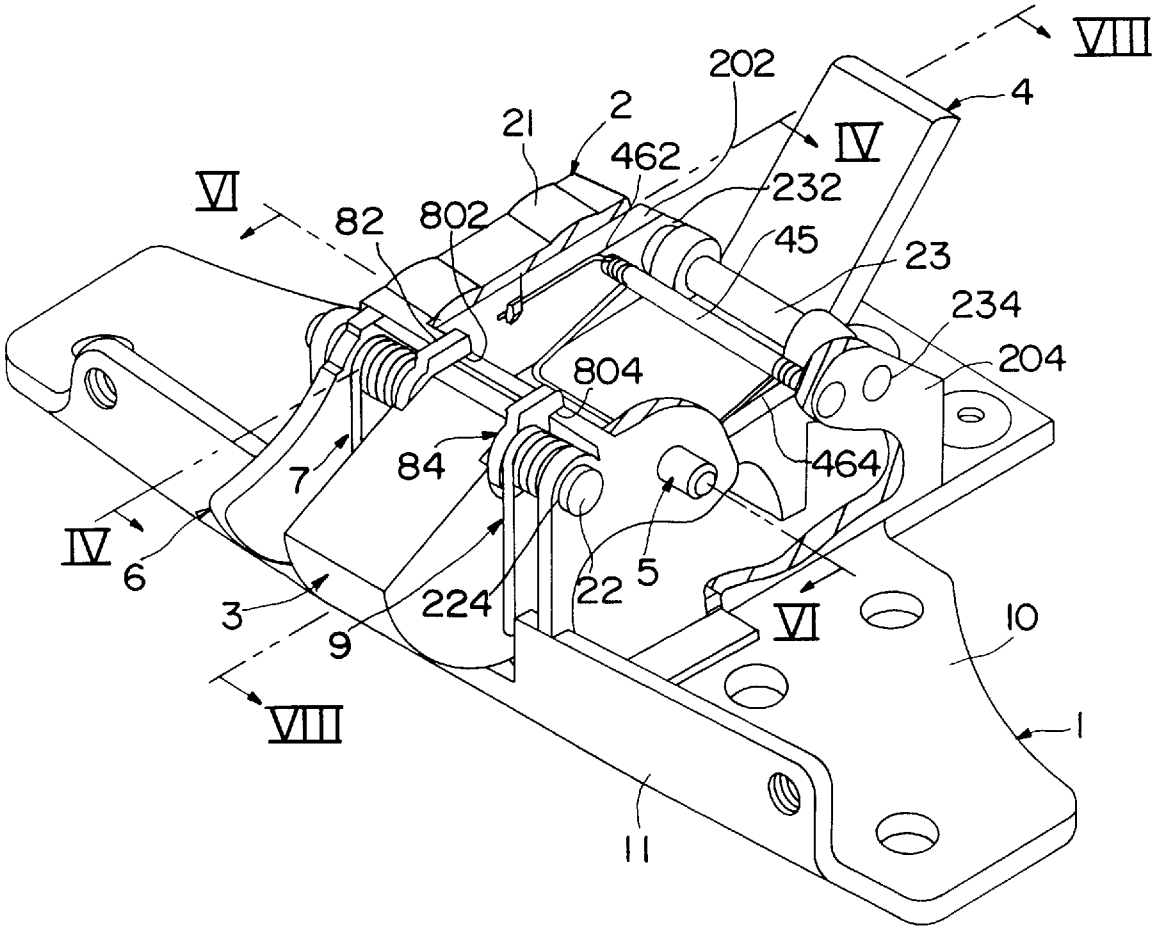
FIG. 3 is a perspective view of the push-type lock for fire-blocking doors according to the present invention.
Figure 4:
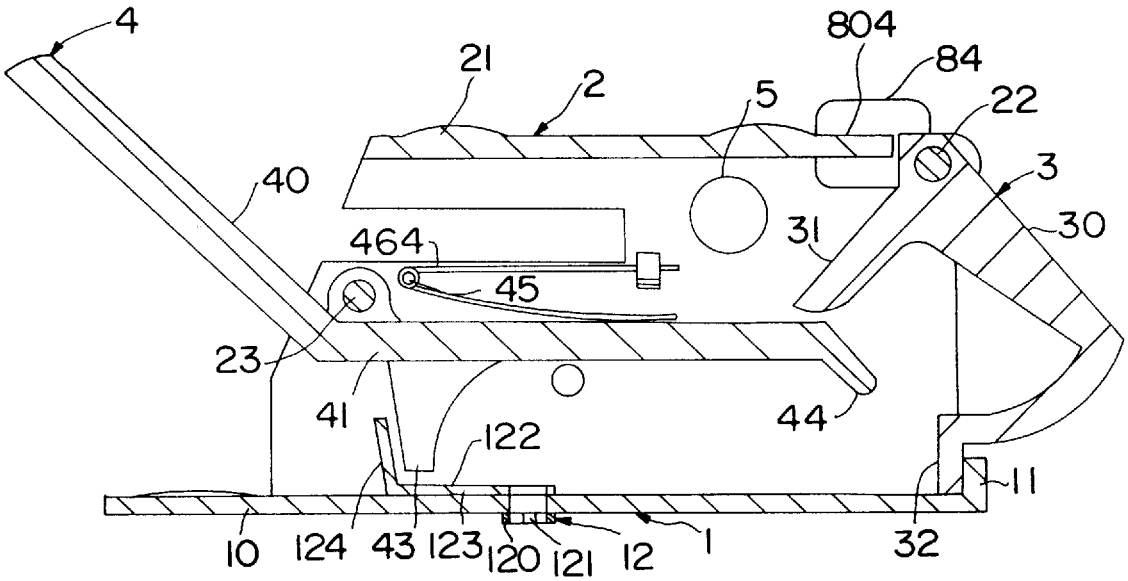
FIG. 4 is a sectional view of the push-type lock of FIG. 3 cutting through the line B—B.
Figure 5:
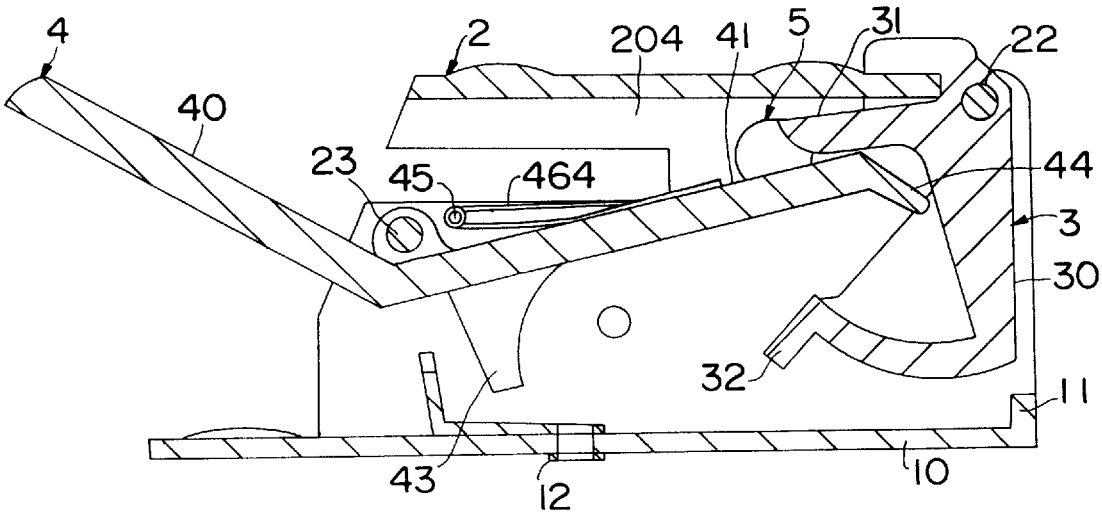
FIG. 5 shows the push-type lock of FIG. 4 when a press bar is pressed down.

As shown in FIG. 3, the first shaft 22 is axially coupled with a number of components including a safety latching member 6, a first spiral spring 7, a first. deformation preventing piece 82 and a second deformation prevention rig piece 84 (which are each a fixed piece having a hole for the first shaft 22 to pass therethrough) used to guard the latching member 3 therebetween, and a second spiral spring 9. Further, a stop bolt 60 is provided on one side surface of the safety latching member 6. The first spiral spring 7 has one elongated end elastically urging against the bottom of the covering piece 21 and the other elongated end elastically urging against the stop bolt 60. This allows the safety latching member 6 to be positioned on the outside of the frame 2 when subjected to no external force. The first and second deformation preventing pieces 82, 84 are formed with slots 802, 804 respectively, which allow the first and second deformation preventing pieces 82, 84 to be fixedly fitted to the covering piece 21. The first and second deformation preventing pieces 82, 84 can prevent the first shaft 22 and the covering piece 21 from being deformed due to heat from a fire. Referring to FIGS. 4 and 5, the latching member 3 is integrally formed with a latch body 30, an actuating portion 31 formed on the top side of the latch body 30, and a stop portion 32 formed on the bottom side of the latch body 30. The second spiral spring 9 has one elongated end elastically urging against the bottom of the covering piece 21 and the other elongated end elastically urging against, the inner side of the latch body 30. This allows the latching member 3 to be positioned on the outside of the frame 2 when subjected to no external force, and also allows the stop portion 32 on the latching member 3 to abut on the deformation preventing sidewall 11 of the base body 1, as illustrated in FIG. 4.

The actuating piece 4 is pivotally coupled to the second shaft 23 and includes a driving portion 40 and a passive portion 41 extended oppositely from either sides of the second shaft 23. The passive portion 41 is further formed with an urging piece 42 extended in inclined direction downwards from the free end thereof, a fork-like driving piece 43 extended in inclined direction downwards from the bottom thereof, and a tongue-like piece 44, which is spaced from the urging piece 42, formed on the free end thereof and extended in inclined direction downwards. The passive portion 41 of the actuating piece 4 is extended to the underneath of the actuating portion 31 on the latching member 3. When the driving portion 40 of the actuating piece 4 is pressed down, the passive portion 41 will be pivoted to turn in the counter-clockwise direction (with reference to the side view of the drawings) about the second shaft 23, thereby urging upwards against the actuating portion 31. As a result of this, the latching member 3 is pivoted to turn in the clockwise direction about the first shaft 22, thereby causing the latch body 30 of the latching member 3 to be withdrawn to the inside of the frame 2. The push-type lock is thus unlatched as illustrated in FIG. 5.

Moreover, a third shaft 45 is provided on the frame 2 near the second shaft 23. The third shaft 45 has its two ends axially coupled with a pair of third spiral springs 462, 464, each having a first elongated end affixed to the inner surface of the bearing plates 202, 204 of the frame 2 and a second elongated end abutting on the top surface of the passive portion 41 of the actuating piece 4 allowing the passive portion 41 to be biased with a downward pressure. By this arrangement, when the safety latching member 6 is not subjected to any external force, the urging piece 42 on the actuating piece 4 is abutted on the stop bolt 60 on the safety latching member 6, thus allowing the passive portion 41 of the actuating piece 4 to be positioned horizontally. However, when the safety latching member 6 is withdrawn to the inside of the frame 2 (i.e., when the push-type lock latches the door), the stop bolt 60 is retracted to the underneath of the joint between the urging piece 42 and the, passive portion 41 (referred to FIG. 9). At this time, due to the elasticity of the third spiral springs 462, 464, the passive portion 41 is urged downwards, causing the tongue-like piece 44 of the passive portion 41 to be lowered toward the stop portion 32 of the latching member 3. As a result, of this, the latching member 3 is impeded from withdrawing to the inside of the frame 2 unless the actuating piece 4 is pressed by an external force. In other words, when the push-type lock latches the fire-blocking door, the fire-blocking door can be opened only by pressing against the actuating piece 4.

Figure 6:
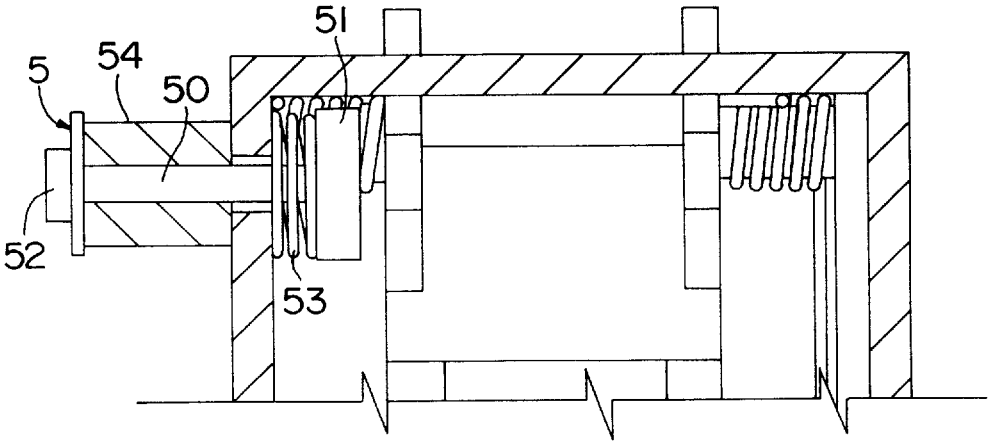
FIG. 6 is a sectional view of the push-type lock of FIG. 3 cutting through the line C—C.
Figure 7:
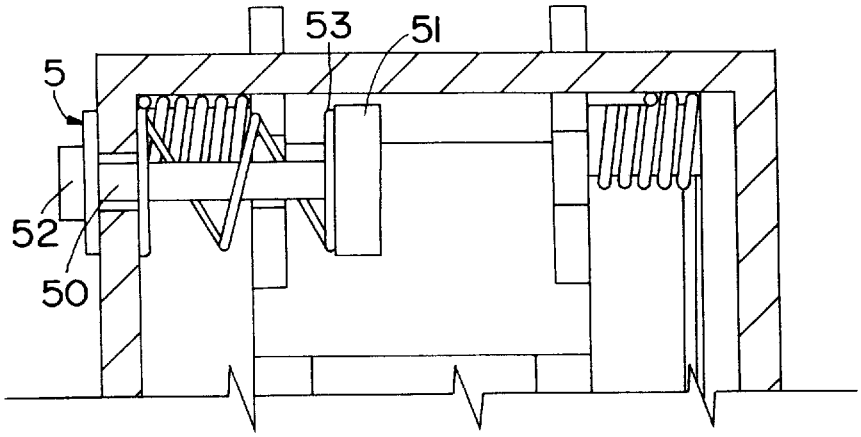
FIG. 7 shows the push-type lock of FIG. 6 after a sleeved meltable member is melt away.
Figure 8:
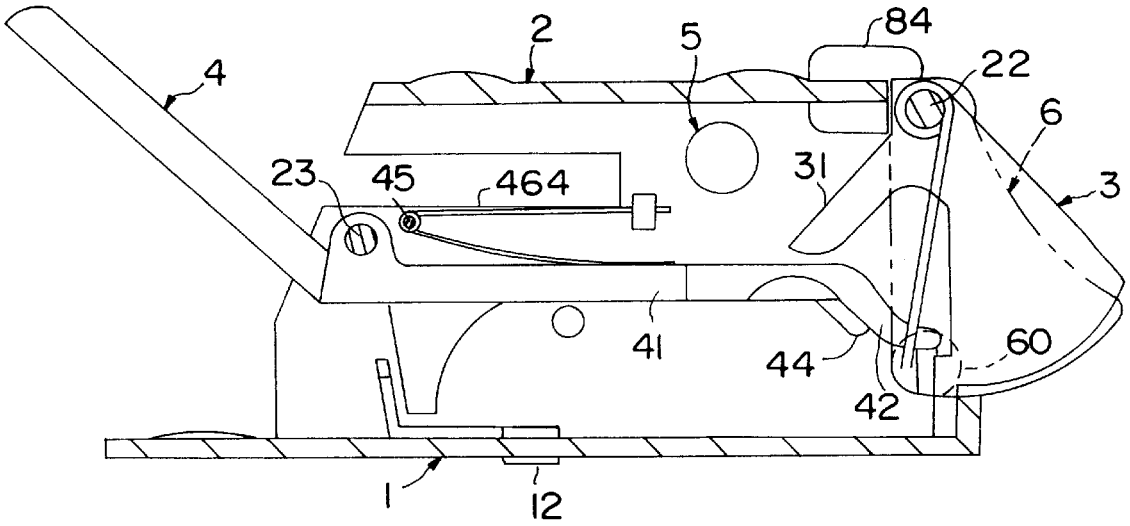
FIG. 8 is a sectional view of the push-type lock of FIG. 3 cutting through the line D—D.
Figure 9:
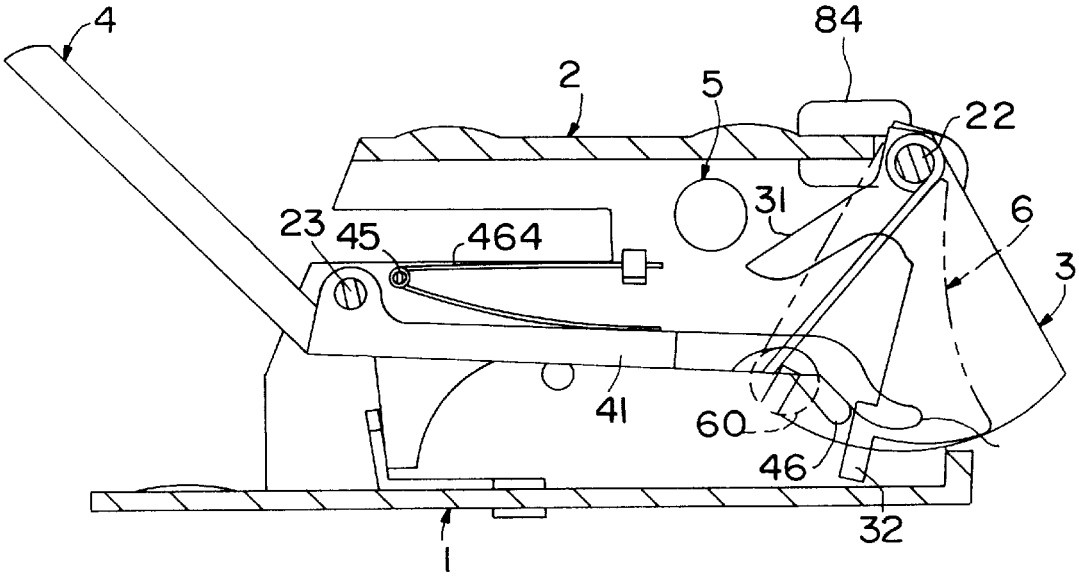
FIG. 9 shows the push-type lock of FIG. 8 when the bolt is drawn back inside the casing.

Referring further to FIGS. 6 arid 7, the safety release unit 5 is composed of a cylindrical rod 50 having its two ends affixed with an inner end 51 and an outer end 52 respectively, a spiral spring 53 coupled axially to the cylindrical rod 50 and positioned in compressed condition between the inner end 51 and the inner surface of the bearing plate 204, and a hot-melt tub 54 sleeving the cylindrical rod 50 between the outer end 52 and the outer surface of the bearing plate 204. The hot-melt tub 54 is made of a hot-melt plastic material which will the melt away at the temperature of flames, thus allowing the hot-melt tub 54 to be melted away when a fire breaks out. As a consequence of the hot-melt tub 54 being melted away, the blocking effect rendered by the cylindrical rod 50 is released. Namely, the cylindrical rod 50 will be forced to the inside of the frame 2 due to the elasticity of the compressed spiral spring 53, as illustrated in FIG. 7. This allows the safety release unit 5 to move to a position blocking up the way the latching member 3 can be withdrawn to the inside of the frame 2. In this case, the latching member 3 is prevented from being withdrawn to the inside of the frame 2, thus securely latching the door when a fire breaks out.

Further, if a person wishes to open the door from the other side, he/she needs to insert an associated key into the keyhole 121 to turn the driving unit 12 and thereby the driving bar 122. This causes the upward extended portion 124 of the driving bar 122 to urge against the fork-like driving piece 43 of the actuating piece 4, thus allowing the fork-like driving piece 43 to drive the passive portion 41 to turn in the counterclockwise direction. As a result of this, the actuating portion 31 is urged to withdraw the latch body 30 to the inside of the frame 2, thus unlatching the door. The door thus can be opened.

Figure 10:
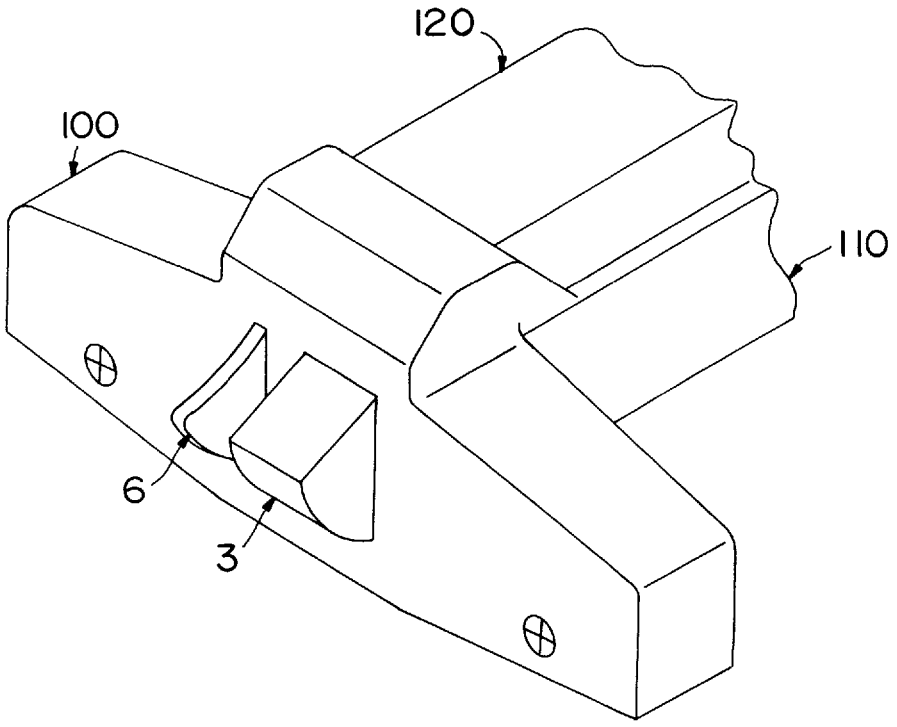
FIG. 10 is a perspective view of the locking part of the push-type lock according to the present invention.

FIG. 10 further shows the push-type lock of the invention installed to the inner side of a fire-blocking door. The push-type lock is mounted in a casing 100 which is fixed to a support 110 on which a press plate 120 is coupled.

In conclusion, the push-type lock for fire-blocking doors according to the present invention allows the door to be securely latched by the provision of the safety release unit 5 which prevents the latching member 3 from being withdrawn to the inside of the frame 2 in the event of a fire. The door thus can be latched securely in the event of a fire to prevent smoke and flames from the fire to spread to emergency staircase. Besides, the deformation preventing sidewall 11 together with the first deformation preventing piece 82 and the second deformation preventing piece 84 can effectively prevent the base body 1, actuating piece 4, first shaft 22, second shaft 23, and frame 2 from being deformed due to heat from the fire. The push-type lock is thus more reliable to use.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest. interpretation so as to encompass all such modifications and similar arrangements.

What is claimed is:

1. A push-type lock for a fire-blocking door, comprising:

(a) a base body including a plate member;

(b) a frame mounted on said base body and including a pair of spaced apart bearing plates;

(c) a safety release unit penetratingly secured to one of said pair of bearing plates of said frame and including a rod member, an inner end formed on one end of said rod member, an outer end formed on the other end of said rod member, an elastic member coupled axially to said rod member and positioned in compressed condition between said inner end and the inner surface of said one bearing plate of said frame, and a hot-melt member sleeving said rod member between said outer end and the outer surface of said one bearing plate of said frame;

(d) a latching member pivotally coupled to a first pivot shaft which extends through the pair of bearing plates of said frame, and including a latch body, an actuating portion formed on the top side of said latch body, and a stop portion formed on the bottom side of the latch body, said safety release unit being positioned so as to block said latching member when activated;

(e) an actuating piece pivotally coupled on said frame, and including a driving portion and a passive portion linked to said driving portion and extending substantially horizontally from said driving portion to the underneath of said actuating portion of said latching member, and (f) means for preventing deformation of the pivot shaft including at least a first and second deformation piece in contact with the pivot shaft and the frame.

2. The push-type lock of claim 1, wherein said first pivot shaft is pivotally coupled with a safety latching member.

3. The push-type lock of claim 2, wherein said safety latching member includes a latch piece and a stop bolt projectingly provided on a side surface of said latch piece.

4. The push-type lock of claim 1, wherein a first spiral spring is further axially coupled to said first pivot shaft between said safety member and said latching member, and a second spiral spring is also axially coupled to said first pivot shaft between said latching member and a sidewall of said frame.

5. The push-type lock of claim 4, wherein said first spiral spring has a first elongated end urging against said frame, and a second elongated end urging against. said stop bolt of said safety member, thereby allowing said safety member to he propelled to the outside of said frame when said safety member is subjected to no external force.

6. The push-type lock of claim 4, wherein said second spiral spring has a first elongated end urging against said frame, and a second elongated end urging against said latch body of said latching member, thereby allowing said latching member to be propelled to the outside of said frame when said latching member is subjected to no external force.

7. The push-type lock of claim 1, wherein first deformation preventing piece is further coupled to said first pivot shaft between a first spiral spring and said latching member, and the second deformation preventing piece is coupled to said first pivot shaft between said latching member and a second spiral spring, said first and second deformation preventing pieces each having one end affixed to said frame.

8. The push-type lock of claim 1, wherein said passive portion of said actuating piece includes a tongue-like piece extending downwards from one end thereof and an urging piece, which is spaced from said tongue-like piece, extending downwards from one end thereof to come into abutting on said stop bolt of said safety member.

9. The push-type lock of claim 1, further including a second shaft supported on said frame for pivotally couplings said actuating piece thereon.

10. The push-type lock of claim 1 wherein said driving portion of said actuating piece further includes a fork-like driving piece extending downwards from the bottom thereof.

11. The push-type lock of claim 1, wherein said frame is provided with a driving unit including a pivoting body having a keyhole therethrough and a driving bar pivotally connected to one end of said pivoting body, such that, when a key is inserted into said keyhole to turn said driving unit, said driving bar will urge against said fork-like driving piece of said actuating piece, thereby allowing said actuating piece to pivot about said second shaft and causing said latching member to be withdrawn to the inside of said frame.

12. The push-type lock of claim 1, wherein said elastic member is a spiral spring.

13. The push-type lock of claim 1, wherein said hot-melt member is made of a hot-melt plastic material.

* * * * *